US009156643B2

(12) United States Patent
Hirabayashi

(10) Patent No.: US 9,156,643 B2
(45) Date of Patent: Oct. 13, 2015

(54) SHEET PRESSING DEVICE AND PRINTER

(71) Applicant: Seiko Epson Corporation, Tokyo (JP)

(72) Inventor: Kenichi Hirabayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/341,410

(22) Filed: Jul. 25, 2014

(65) Prior Publication Data

US 2015/0029282 A1 Jan. 29, 2015

(30) Foreign Application Priority Data

Jul. 25, 2013 (JP) ..... 2013-154268

(51) Int. Cl.

| | |
|---|---|
| ***B41J 2/00*** | (2006.01) |
| ***B65H 16/10*** | (2006.01) |
| ***B65H 23/16*** | (2006.01) |
| ***B65H 20/00*** | (2006.01) |
| ***B41J 11/00*** | (2006.01) |
| *B41J 3/407* | (2006.01) |

(52) U.S. Cl.

CPC ..... *B65H 16/10* (2013.01); *B41J 11/0045* (2013.01); *B65H 20/00* (2013.01); *B65H 23/16* (2013.01); *B41J 3/4075* (2013.01)

(58) Field of Classification Search

CPC ..... B41J 2/0057; B41J 3/4076; B41J 25/308; B41J 25/3088; B41J 29/393

USPC ..... 347/110

See application file for complete search history.

(56) References Cited

U.S. PATENT DOCUMENTS

| | | | | |
|---|---|---|---|---|
| 6,176,411 | B1 * | 1/2001 | Suketomo | 226/59 |
| 6,450,384 | B1 * | 9/2002 | Chinzei et al. | 226/59 |
| 2009/0097897 | A1 * | 4/2009 | Kim et al. | 400/642 |
| 2012/0098190 | A1 | 4/2012 | Nieda et al. | |
| 2012/0242037 | A1 | 9/2012 | Nieda et al. | |
| 2013/0140768 | A1 | 6/2013 | Nieda et al. | |

FOREIGN PATENT DOCUMENTS

| | | | |
|---|---|---|---|
| JP | 59-138539 | A | 8/1984 |
| JP | 63-258323 | A | 10/1988 |
| JP | 04-016431 | A | 1/1992 |
| JP | 07-285681 | A | 10/1995 |
| JP | 11-334952 | A | 12/1999 |
| JP | 2012-086976 | A | 5/2012 |

* cited by examiner

*Primary Examiner* — Manish S Shah
*Assistant Examiner* — Yaovi Ameh
(74) *Attorney, Agent, or Firm* — Nutter McClennen & Fish LLP; John J. Penny, Jr.

(57) ABSTRACT

A sheet pressing device enables reliably pivoting a presser lever that presses a sheet material to a feed path surface to a pressure position and a released position. The sheet pressing device has a movable-side presser lever configured to pivot between a pressure position where die-cut label paper conveyed over the feed path surface is pressed by a sheet presser part to a flat surface, and a released position where the sheet presser part is separated from the die-cut label paper; and a lever spring respectively urges the movable-side presser lever to the pressure position or the released position from a neutral point between the pressure position and the released position.

5 Claims, 11 Drawing Sheets

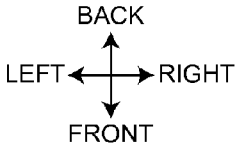
FIG. 10A
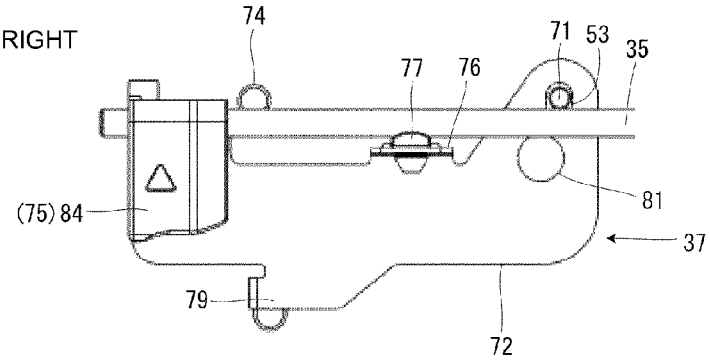
FIG. 10B
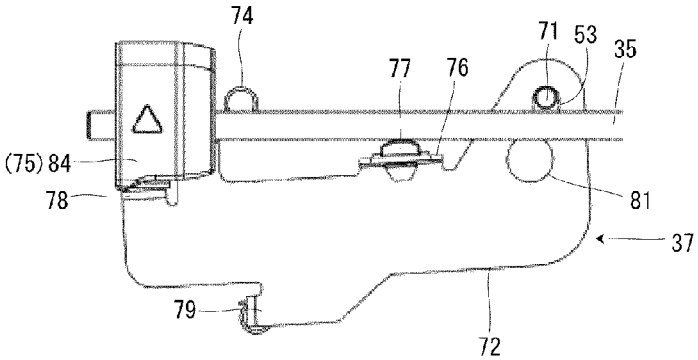
FIG. 10C
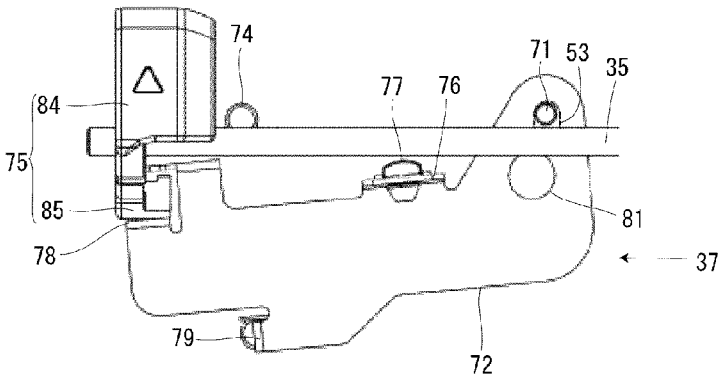

SHEET PRESSING DEVICE AND PRINTER

BACKGROUND

1. Technical Field

The present disclosure relates to a sheet pressing device that presses sheet material to a conveyance path surface, and to a printer having the sheet pressing device.

2. Related Art

Sheet conveyance devices that convey sheet materials (sheets) over a conveyance path (paper feed) surface are known from the literature. See, for example, JP-A-2012-086976.

A pressure lever that presses the sheet material to the feed path surface could conceivably be provided to prevent the sheet material from separating from the feed path surface in this type of sheet conveyance device. Setting the sheet material to the feed path surface would be more convenient in this device if the pressure lever could pivot between a pressure position where it presses the sheet material to the feed path surface and a release position where it is separated from the sheet material. When thus configured, the pressure lever is preferably urged by a spring to the pressure position so that the pressure lever pushes against the sheet material, and the pressure lever can be held in the release position. A ball and detent mechanism that holds the pressure lever in the release position in resistance to the spring could conceivably be used, but if the user does not rotate the pressure lever against the spring until the ball engages the detent, the pressure lever will be returned to the pressure position by the urging force of the spring.

SUMMARY

The present disclosure is directed to a sheet pressing device enabling reliably rotating a presser lever that presses a sheet material to a feed path surface to a pressure position and to a release position, and to a printer having the sheet pressing device.

A sheet pressing device according to at least one embodiment of the invention comprises a pressure lever configured to pivot between a pressure position where a sheet material conveyed over the feed path surface is pressed to the feed path surface by a sheet presser part, and a released position where the sheet presser part is separated from the sheet material; and an elastic member that urges the pressure lever to the pressure position or the released position from a neutral point between the pressure position and the released position.

Because this configuration has an elastic member that respectively urges the pressure lever to a pressure position or a released position from a neutral point, the user rotates the pressure lever in resistance to the elastic member from the pressure position to the neutral point when pivoting the pressure lever from the pressure position to the released position, but the urging direction of the elastic member changes when the neutral point is passed, and the pressure lever can then be rotated further to the released position without resistance from the elastic member.

Likewise when pivoting the pressure lever from the released position to the pressure position, the user rotates the pressure lever in resistance to the elastic member from the released position to the neutral point, the urging direction of the elastic member changes when the neutral point is passed, and the pressure lever can then be rotated further to the pressure position without resistance from the elastic member.

The pressure lever that presses the sheet material to the feed path surface can therefore be positively rotated to a pressure position and a released position.

Preferably, the sheet pressing device also has a base unit that can slide on a transverse axis perpendicular to the conveyance direction; an advancing/retracting member having a guide surface that guides a side edge of the sheet material conveyed over the feed path surface, and is the advancing/retracting member being held on the base unit movably between an advanced position and a retracted position relative to the sheet material; and an interlocking mechanism that advances the advancing/retracting member to the advanced position and holds the advancing/retracting member in the advanced position in conjunction with the pressure lever rotating to the released position, and retracts the advancing/retracting member to the retracted position in conjunction with the pressure lever rotating to the pressure position.

By rotating the pressure lever to the released position when setting the sheet material to the feed path surface, the pressure lever rotates to the released position due to the elastic member, and in conjunction therewith the advancing/retracting member advances to the advanced position and is held in the advanced position by the elastic member. As a result, the user can easily set the sheet material to the feed path surface when the pressure lever is pivoted to the released position, set the sheet material against the guide surface of the advancing/retracting member held in the advanced position, and then slide the base unit to adjust the guide width. By pivoting the pressure lever to the pressure position to convey the sheet material over the feed path surface, the elastic member causes the pressure lever to pivot to the pressure position and the advancing/retracting member to retract to the retracted position. As a result, the sheet material is prevented from lifting away from the feed path surface by the pressure lever, and the sheet material can be desirably conveyed without excess feed resistance on the sheet material because the guide width is wider than the adjusted guide width.

Because the advancing/retracting member moves back and forth in conjunction with the pivoting of the pressure lever, the user can simultaneously operate the pressure lever and advance or retract the advancing/retracting member, and ease of use can be improved.

Further preferably, the interlocking mechanism includes a lever engaging part that is formed on the pressure lever, engages the advancing/retracting member when the pressure lever rotates to the released position, and separates from the advancing/retracting member when the pressure lever rotates to the pressure position; an advancing/retracting member pusher that is formed to the pressure lever, pushes the advancing/retracting member to the retracted position when the pressure lever rotates to the pressure position, and retracts from the advancing/retracting member when the pressure lever rotates to the released position; and an elastic member that urges the advancing/retracting member to the advanced position through the pressure lever.

When the pressure lever rotates to the released position side in this configuration, the elastic member causes the pressure lever to pivot to the released position and the lever engaging part of the pressure lever to engage the advancing/retracting member. As a result, the advancing/retracting member is urged by the elastic member to the advanced position. When the pressure lever pivots to the pressure position side, the lever engaging part of the pressure lever separates from the advancing/retracting member. As a result, urging the advancing/retracting member to the advanced position by the elastic member through the pressure lever is released. Because the advancing/retracting member pusher of the pressure lever rotated to the pressure position pushes the advancing/retracting member to the retracted position when the urging force is released, the advancing/retracting member retracts to the retracted position. An interlocking mechanism that holds the advancing/retracting member in the advanced position in conjunction with the pressure lever pivoting to the released position, and causes the advancing/retracting member to retract in conjunction with the pressure lever pivoting to the pressure position, can thus be easily configured.

Further preferably, the advancing/retracting member pusher presses against the guide surface of the advancing/retracting member.

This configuration can reliably retract the guide surface of the advancing/retracting member because the advancing/retracting member pusher of the pressure lever pushes directly against the guide surface of the advancing/retracting member.

Further preferably, the pressure lever has a sheet presser part at plural dispersed locations in the conveyance direction; and a plurality of urging members that respectively urge the plural sheet presser parts toward the sheet material.

This configuration enables applying uniform pressure to the sheet material between the plural sheet presser parts.

Another aspect of at least one embodiment of the invention is a printer that has the sheet pressing device according to the disclosure, a conveyance unit that conveys the sheet material over the feed path surface, and a print unit that prints on the sheet material.

A printer according to this embodiment of the invention has a sheet pressing device that can cause a presser lever that pushes a sheet material to a feed path surface to pivot easily between a pressure position and a released position, and can thereby improve the ease of setting a sheet material used as the print medium to the feed path surface.

Other objects and attainments together with a fuller understanding of the disclosure will become apparent and appreciated by referring to the following description and claims taken in conjunction with the accompanying drawings.

BRIEF DESCRIPTION OF THE DRAWINGS

FIG. 10A is a plan view of the lock mechanism of the movable part when the lock plate is rotated to the locked position, FIG. 10B shows the lock plate rotated to a middle position, and FIG. 10C shows the lock plate rotated to the unlocked position.

DESCRIPTION OF EMBODIMENTS

A preferred embodiment of the present disclosure is described below with reference to the accompanying figures. The printer in this embodiment is an inkjet printer that prints on die-cut label paper and other print media. The printer connects by wire or wirelessly to a personal computer, smartphone, tablet computer, or other data processing terminal through a USB (Universal Serial Bus) cable or LAN (local area network), and prints based on print data sent from the data processing terminal.

Figure 1A:
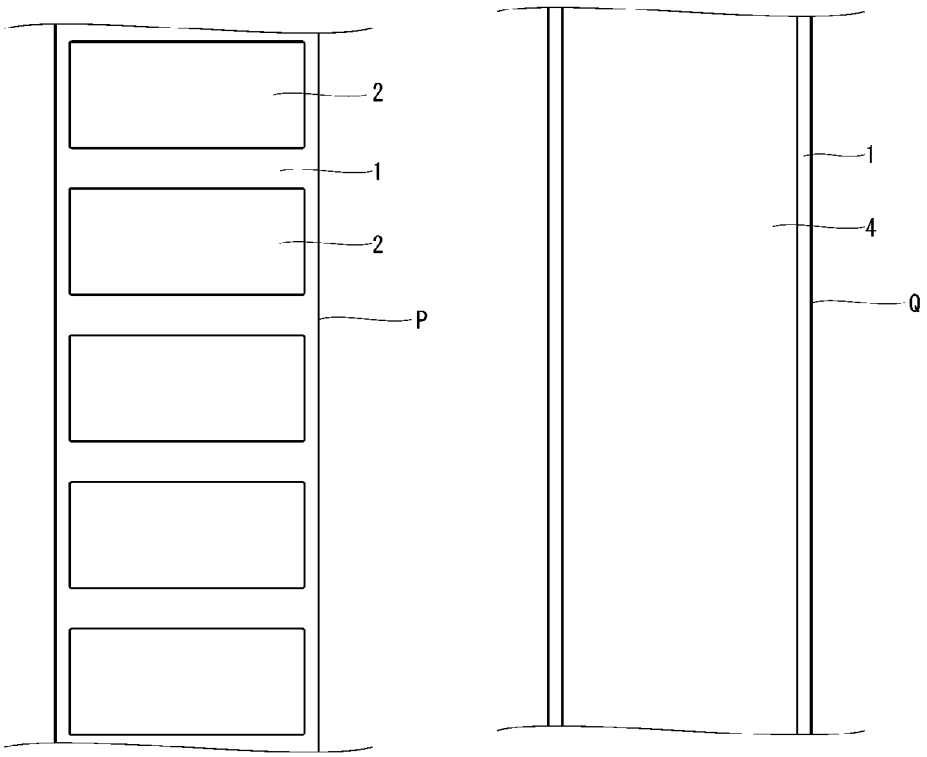
FIG. 1A is a plan view and FIG. 1B is a partial section view illustrating die-cut label paper as an example of a print medium.
Figure 1B:
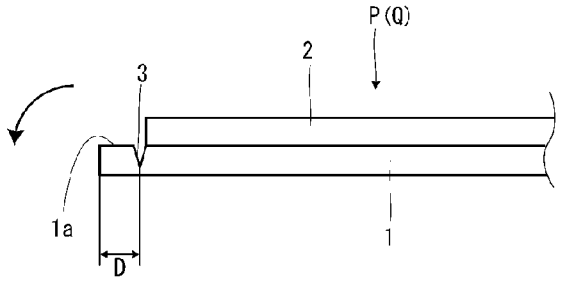

As shown in FIGS. 1A and 1B, die-cut label paper P (sheet material) used as the print medium has a continuous web liner 1, and multiple labels 2 adhesively affixed to the coated side 1*a* of the liner 1. The multiple labels 2 are precut by a die-cutting process. An incision 3 produced in the die-cutting process is formed in the coated side 1*a* of the liner 1 at a position separated a specific distance (margin D) from the edge of the liner 1. This margin D is typically several millimeters, for example. As indicated by the arrow in FIG. 1B, the die-cut label paper P can be easily folded back to the coated side 1*a* at the position where the incision 3 is formed.

Figure 2A:
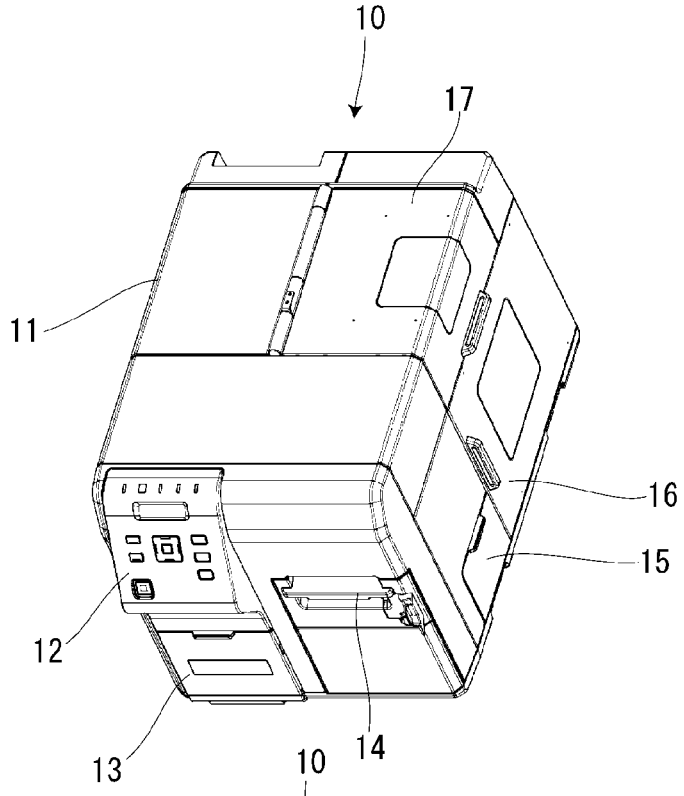
FIG. 2A is an oblique view of a printer according to a first embodiment of the invention when an access cover is closed.
Figure 2B:
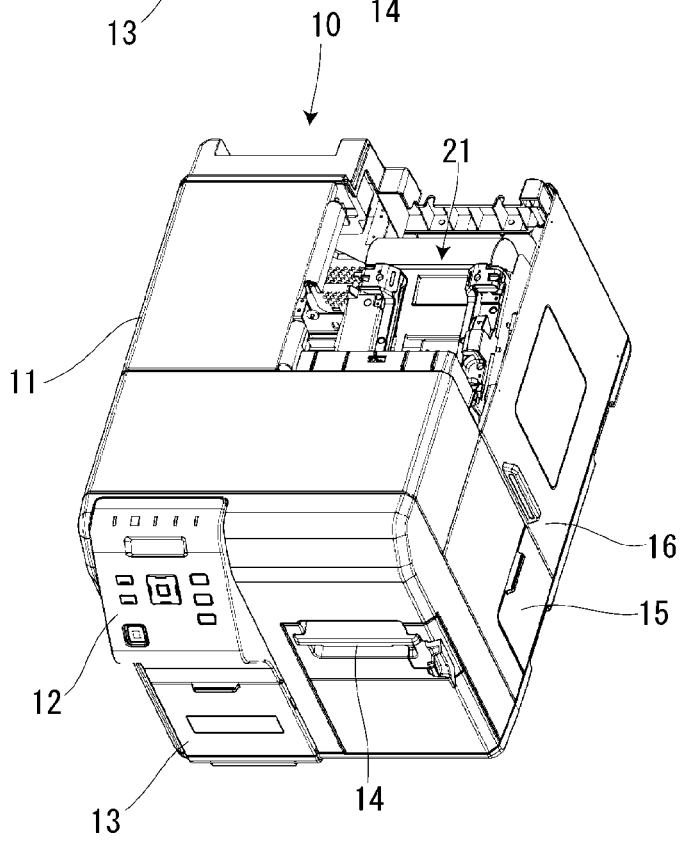
FIG. 2B is an oblique view when the access is open.

As shown in FIGS. 2A and 2B, the printer 10 has a box-like printer case 11. An operating panel 12 populated with operating buttons is disposed on the top left part of the front of the printer case 11, and a pull-out ink cartridge replacement opening 13 is formed below the operating panel 12. A paper discharge slot 14 from which the printed die-cut label paper P is discharged is formed in middle of the right front side of the printer case 11.

A waste ink tank replacement opening 15 is disposed on the bottom front side of the right side of the printer case 11, and a large roll paper supply opening 16 is disposed towards the back beside the waste ink tank replacement opening 15.

A roll paper compartment 20 (see FIG. 3) is formed inside the roll paper supply opening 16. The die-cut label paper P is wound into a roll with the coated side 1*a* to the outside, and is loaded in the roll paper compartment 20 for delivery through the conveyance path. The user loads a roll of die-cut label paper P into the roll paper compartment 20 from the roll paper supply opening 16.

An access cover 17 that opens to the side pivoting on a hinge disposed substantially in the middle of the case top is also disposed on the printer case 11. A guide unit 21 that prevents skewing of the conveyed die-cut label paper P is housed inside the access cover 17.

Figure 3:
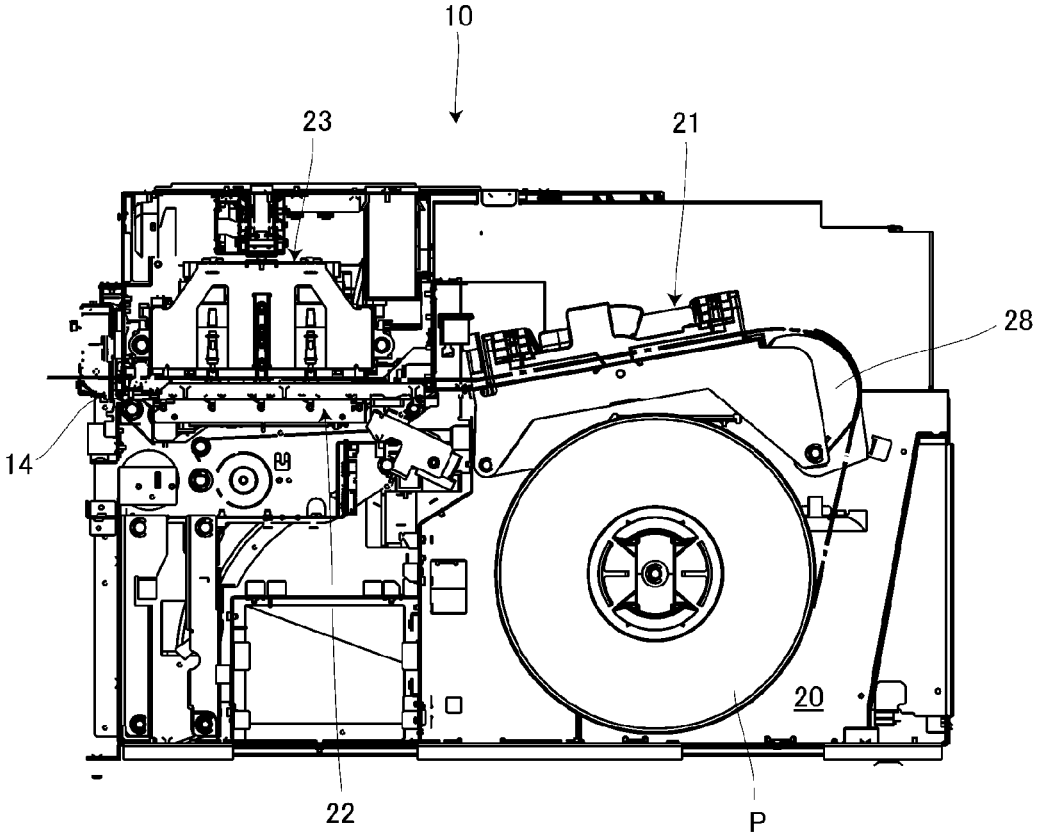
FIG. 3 is a side section view of the printer.

As shown in FIG. 3, the printer 10 has a roll paper compartment 20, a guide unit 21 disposed above the roll paper compartment 20, a feed unit 22 (conveyance unit) that conveys the die-cut label paper P pulled from the roll paper compartment 20, and a print unit 23 that prints with an inkjet head on the labels 2 of the conveyed die-cut label paper P. The feed unit 22 has multiple rollers disposed along the conveyance path, and a motor that drives the rollers, and is configured to convey the die-cut label paper P forward and reverse.

In the following description of the guide unit 21, referenced to the forward conveyance direction in which the die-cut label paper P is fed toward the paper discharge slot 14, the upstream side of the conveyance direction is also referred to as the "front," and the downstream side in the conveyance direction is also referred to as the "back" on the longitudinal axis. The right side when facing downstream in the conveyance direction is also referred to as the right, and the left side as the left, on the transverse axis.

The directions perpendicular to the surface of the feed plate 25 (described below) of the guide unit 21 are also referred to as "up" and "down."

These directions are for convenience of description only, and implementations of the invention are not limited thereto.

Figure 4:
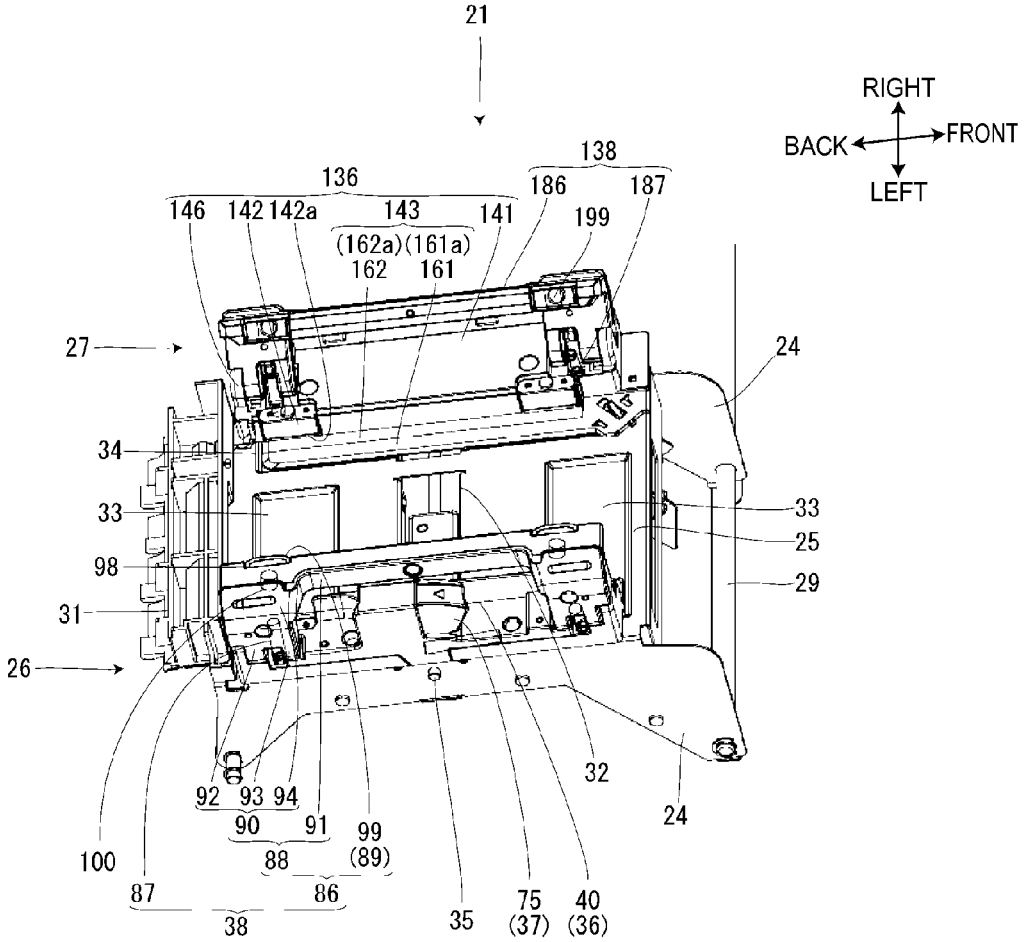
FIG. 4 is an oblique view of a guide unit in the printer when the movable-side presser lever and the stationary-side presser lever are rotated to the release position.
Figure 5:
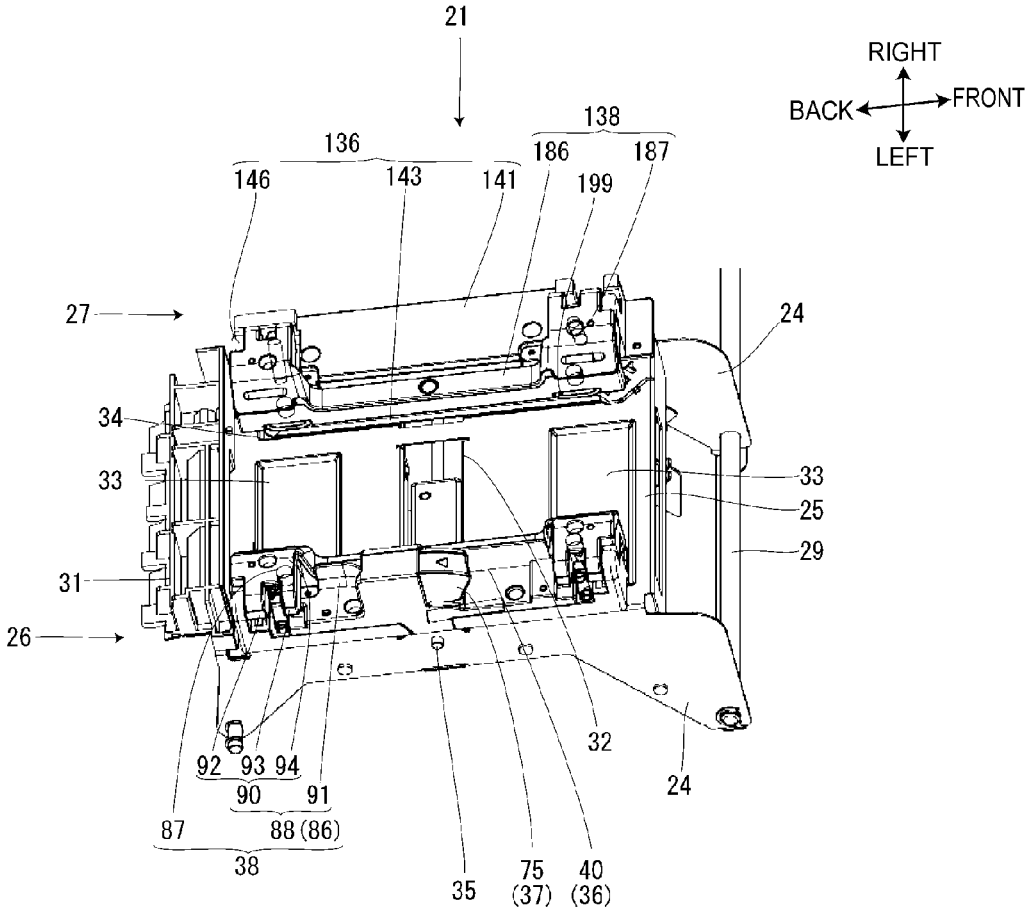
FIG. 5 is an oblique view of the guide unit in the printer when the movable-side presser lever and the stationary-side presser lever are closed to the pressure position.

As shown in FIG. 4 and FIG. 5, the guide unit 21 has support frames 24 on the left and right, a substantially rectangular feed plate 25 disposed between the left and right support frames 24, a movable part 26 disposed on the left side part of the feed plate 25, and a stationary part 27 disposed on the right side part of the feed plate 25.

A tension rod 29 pivotably supporting a tension lever 28 (FIG. 3) that applies desirable tension to the conveyed die-cut label paper P is fixed at the front end of the support frames 24. A roller cover 31 that has a feed roller that feeds the die-cut label paper P pulled by the user from the roll paper compartment 20 toward the print unit 23 is supported above the back end of the feed plate 25. When loading the die-cut label paper P to the feed plate 25, the user sets the leading end of the die-cut label paper P pulled from the roll paper compartment 20 against the feed roller. The die-cut label paper P is set at this time so that the coated side 1*a* is exposed, that is, so that the coated side 1*a* is on top.

The support frames 24 are substantially rectangular panels with a large trapezoidal notch formed in the bottom. A guide shaft 35 described below is fastened in the middle of the support frames 24. The sides of the feed plate 25 are supported on top of the support frames 24.

The feed plate 25 is a substantially rectangular panel, and the die-cut label paper P is conveyed over the top surface (feed path surface) of the feed plate 25. A rectangular guide window 32 that is long on the transverse axis is formed in the middle of the feed plate 25. A box unit 45 (see FIG. 6) described below is disposed so that it can slide in this guide window 32 widthwise to the printer (on the transverse axis).

A shallow, substantially rectangular guide recess 33 that is long on the transverse axis is formed both in front and back of the guide window 32 in the feed plate 25. A movable-side pressure bearing member 43 (see FIG. 6) described below is also disposed in each guide recess 33.

A shallow, substantially rectangular stationary-side recess 34 whose longer dimension extends along the longitudinal axis is formed on the right side part of the feed plate 25. A stationary-side pressure bearing member 143 described below is press-fit into the stationary-side recess 34.

The movable part 26 includes the guide shaft 35 extending transversely, a movable guide 36 configured to slide on the guide shaft 35, a lock mechanism 37 that locks and unlocks the movable guide 36 to the guide shaft 35, and a movable-side presser mechanism 38 that is disposed on the movable guide 36 and applies pressure to the left side of the die-cut label paper P. Note that the guide shaft 35 is grounded through the support frames 24 described above.

Figure 6:
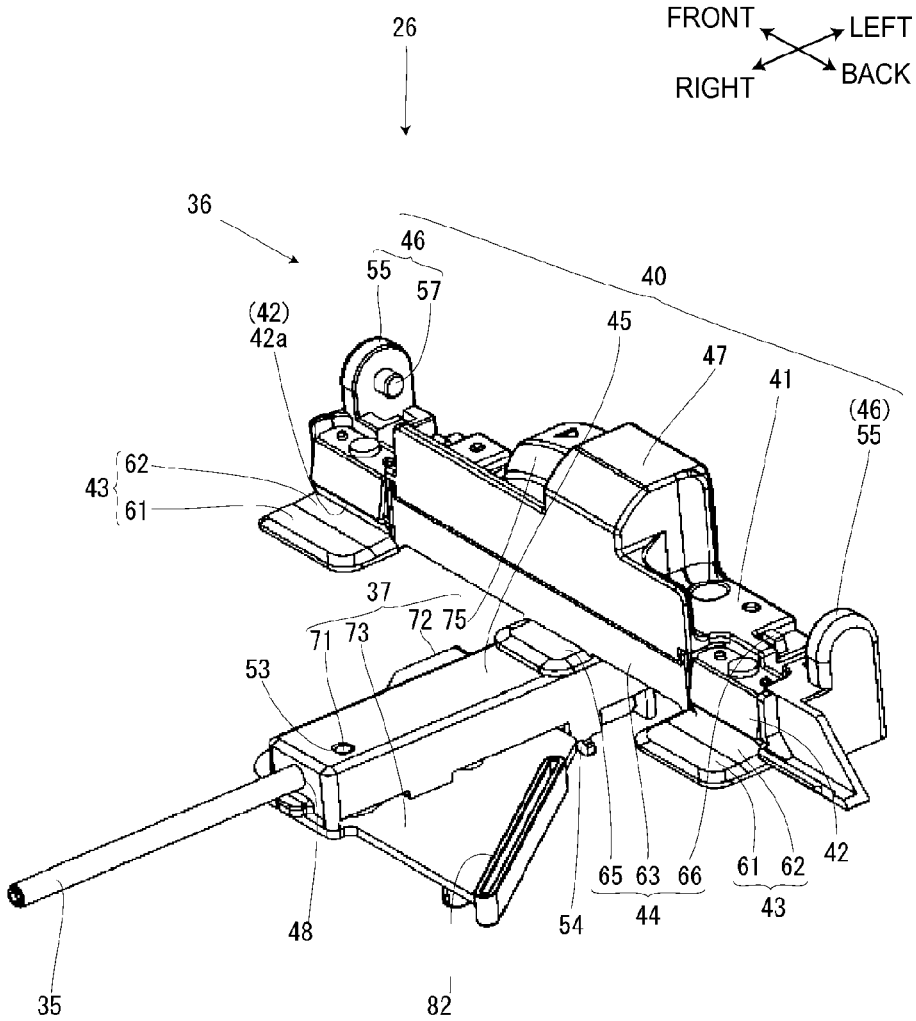
FIG. 6 is an oblique view of the movable part (not including the movable-side presser mechanism) of the guide unit.
Figure 7:
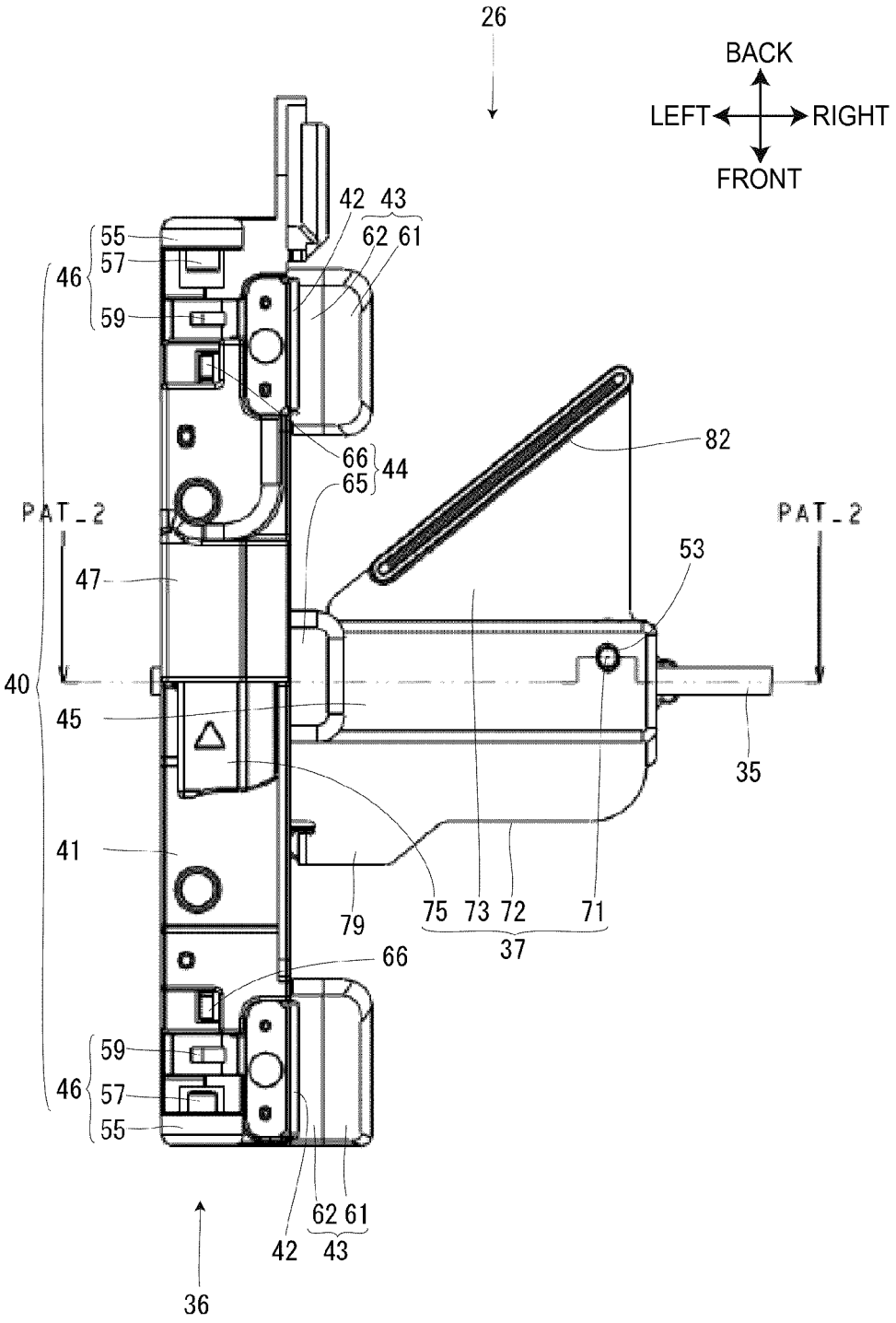
FIG. 7 is a plan view of the movable part (not including the movable-side presser mechanism).
Figure 8:
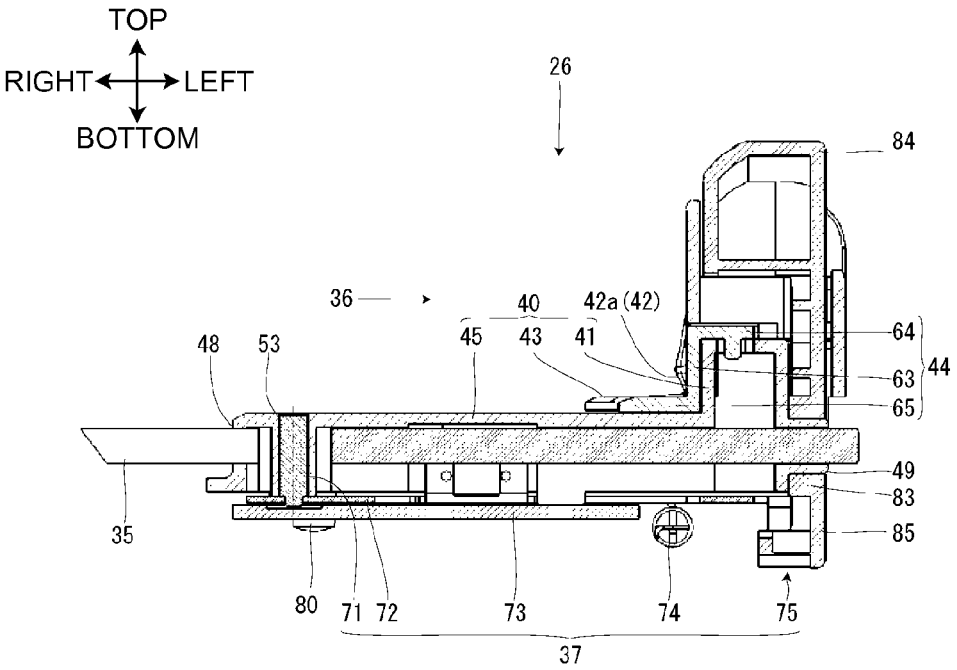
FIG. 8 is a section view of the movable part (not including the movable-side presser mechanism) through the dotted line in FIG. 7.

As shown in FIG. 6 to FIG. 8, the movable guide 36 includes a base 40 attached slidably to the guide shaft 35; two side presser members 42 attached to the front and back ends of the base 40; and a retractable slider 44 (retractable member) that is attached to the base 40 between the two front and back side presser members 42 and can slide toward and away from the die-cut label paper P.

The base 40 includes a base unit 41 disposed extending on the longitudinal axis to the feed plate 25; a basically rectangular box unit 45 extending to the right from the bottom middle part of the base unit 41; two movable-side pressure bearing members 43 disposed on the front and back ends of the base unit 41 opposite the side presser members 42; and two presser lever supports 46 formed at the front and back ends of the base unit 41.

A release lever cover 47 formed to cover the right and left top of a lock release lever 75 described below is disposed on the top of the base unit 41 in the middle between the front and back. The release lever cover 47 also functions as a grip used by the user to rotate the lock release lever 75 to the released position (described below).

The box unit 45 (see FIG. 6) is a rectangular shape with an open bottom, and is supported by the guide shaft 35 to slide in the transverse direction. A guide shaft hole 48 through which the guide shaft 35 passes is formed in the right side of the box unit 45. A short tubular guide tube sleeve 49 is formed protruding from the left side of the box unit 45, and the guide shaft 35 passes through this guide tube sleeve 49 (see FIG. 8). The lock release lever 75 is supported to pivot in the longitudinal direction on the guide shaft 35 through this guide tube sleeve 49.

An oval lock hole 53 that is slightly longer on the longitudinal axis is formed in the top back right corner of the box unit 45. A lock pin 71 described below is fit into this oval lock hole 53. A lock spring catch 54 that holds the back end of a lock spring 74 described below is also formed at the back on the left side of the box unit 45.

The presser lever supports 46 formed at the front and back ends of the base unit 41 each have an inverted, substantially U-shaped shaft support stand 55, and a short columnar support boss 57 is formed protruding from the mutually opposing faces of the two shaft support stands 55. A lever spring bottom catch 59 that holds the bottom end of a lever spring 87 (elastic member) described below is also formed near the inside ends of the two shaft support stands 55.

The side presser members 42 are attached to the front and back ends on the right side of the base unit 41. Each side presser member 42 is made from a flat rectangular member that bends to the right side horizontally near the bottom, and the portion below the bend is a contact surface 42*a*. The left edge of the die-cut label paper P is raised by a pressure-bearing base unit 62 described below so that the left edge of the paper P contacts the contact surface 42*a*. The left edge of the die-cut label paper P is therefore prevented from rising, and wrinkles along the left edge due to the left side of the media rising are prevented.

Each movable-side pressure bearing member 43 protrudes substantially rectangularly to the right from the bottom of the right side of the base unit 41, and has a pressure-bearing end 61 at the distal end with the pressure-bearing base unit 62 at the base.

Figure 9A:
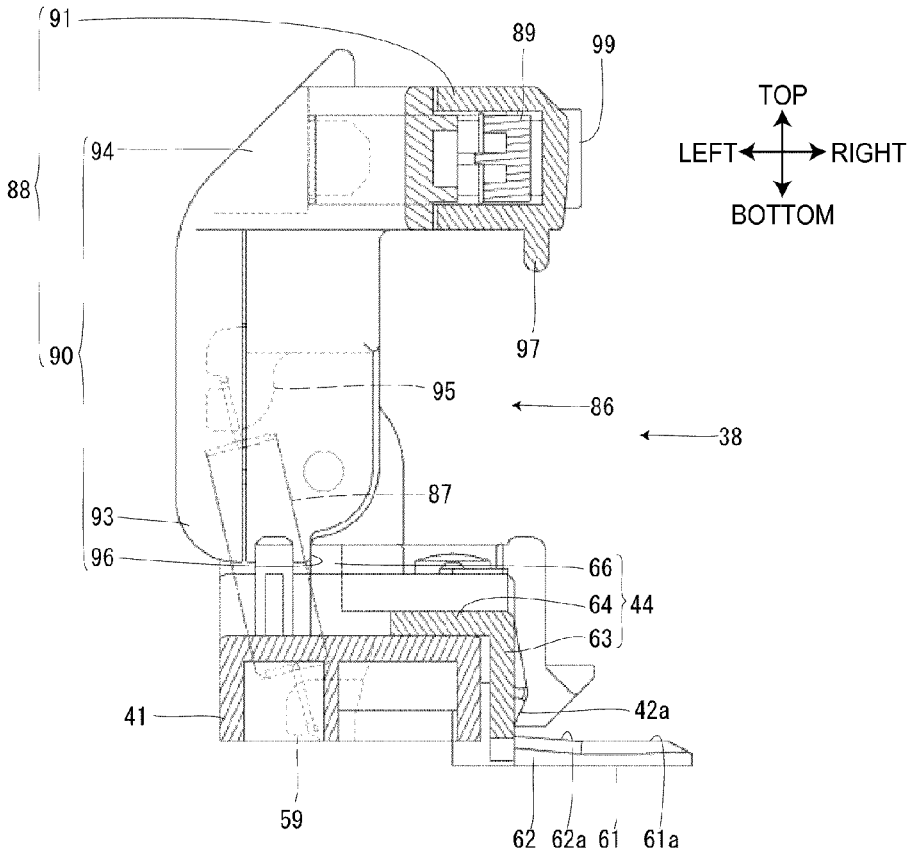
FIG. 9A is a section view of the movable-side presser mechanism through the dotted line in FIG. 11 when the movable-side presser lever is rotated to the release position.

As shown in FIG. 9A, the pressure-bearing end 61 is the part that receives pressure from the movable-side presser lever 86 on the left side of the die-cut label paper P. The top (flat surface 61*a*) of the pressure-bearing end 61 is substantially flush with the top of the feed plate 25. The pressure-bearing base unit 62 is formed protruding to the flat surface 61*a*. More specifically, the top (inclined surface 62*a*) of the pressure-bearing base unit 62 is an incline that rises from the flat surface 61*a* toward the base. This inclined surface 62*a* causes the left side of the die-cut label paper P to slope upward toward the left side. As a result, the left side of the die-cut label paper P is prevented from folding back to the coated surface side (top surface).

The contact surface 42*a* is at an angle θ1 to the inclined surface 62*a*. This angle θ1 is preferably acute, and further preferably 45° to 70°. If the angle is within this range, the contact surface 42*a* can press effectively against the left edge of the die-cut label paper P.

The inclined surface 62*a* is at an angle θ2 to the flat surface 61*a*. This angle θ2 is preferably 2° to 11°. If the angle is in this range, the inclined surface 62*a* can effectively prevent creasing the left side of the die-cut label paper P. The length of the inclined surface 62*a* is preferably greater than the margin D to the incision 3 in the die-cut label paper P. This enables sloping (lifting) the left edge of the die-cut label paper P, including the position where the incision 3 that can fold easily is formed.

The movable-side pressure bearing members 43 are disposed so that they are inside the front and back guide recesses 33 described above, and they can slide transversely guided front and back by the front and back walls of the guide recesses 33. As a result, the movable guide 36 can slide transversely without tilting at an angle to the front and back.

As shown in FIG. 6 to FIG. 9B, the retractable slider 44 is substantially L-shaped, having a slider guide 63 with a guide surface that contacts the left side of the die-cut label paper P, and a slider top wall 64 extending left and right from the top of the slider guide 63 (see FIG. 8). A slider foot 65 is formed extending to the right from the bottom middle of the slider guide 63. A slider stop 66 that engages the presser lever stop 96 of the movable-side presser lever 86 described below is formed at the front and back ends of the retractable slider 44 (see FIGS. 9A and 9B).

The retractable slider 44 moves slightly (such as 0.5 mm) between an advanced position and a retracted position relative to the die-cut label paper P in conjunction with the pivoting action of the movable-side presser lever 86 described below. More specifically, when the movable-side presser lever 86 pivots to the release position, the retractable slider 44 advances to the advanced position, and when the movable-side presser lever 86 pivots to the pressure position, the retractable slider 44 retracts to the retracted position.

The slider guide 63 is basically rectangular and its long side extends along the longitudinal axis, and is perpendicular to the top of the feed plate 25. A slider pusher 97 (described below) of the movable-side presser lever 86 contacts the slider guide 63 when the movable-side presser lever 86 pivots to the closed pressure position.

The slider top wall 64 is supported on the top of the above base unit 41.

The slider foot 65 fits into the guide window 32 described above, and the top of the slider foot 65 is substantially flush with the top of the feed plate 25. The slider foot 65 slides over the top of the box unit 45 while guided longitudinally by the front and back edges of the guide window 32. As a result, the retractable slider 44 can move bidirectionally transversely without tilting at an angle to the longitudinal axis.

The slider stop 66 engages the presser lever stop 96 of the movable-side presser lever 86 when rotated to the release position, and separates from (disengages) the presser lever stop 96 when the movable-side presser lever 86 rotates to the pressure position.

Figure 9B:
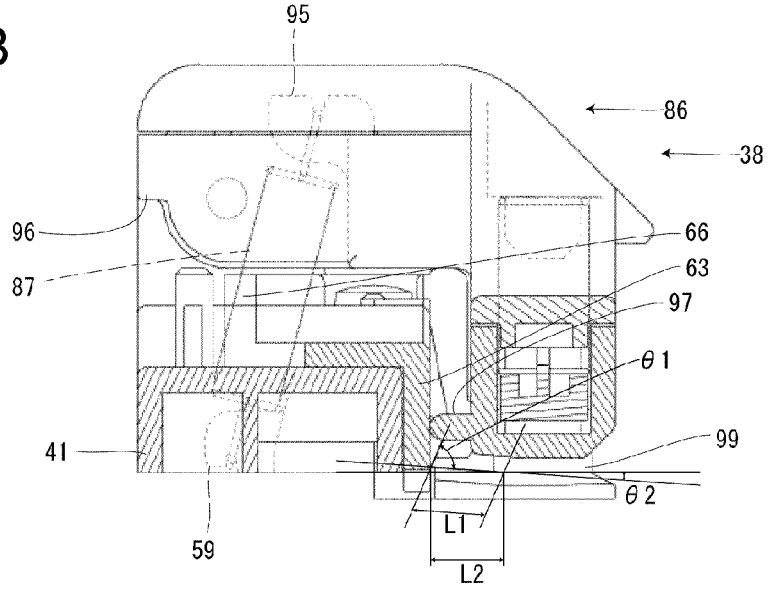
FIG. 9B is a section view when the movable-side presser lever is rotated to the closed pressure position.
Figure 11:
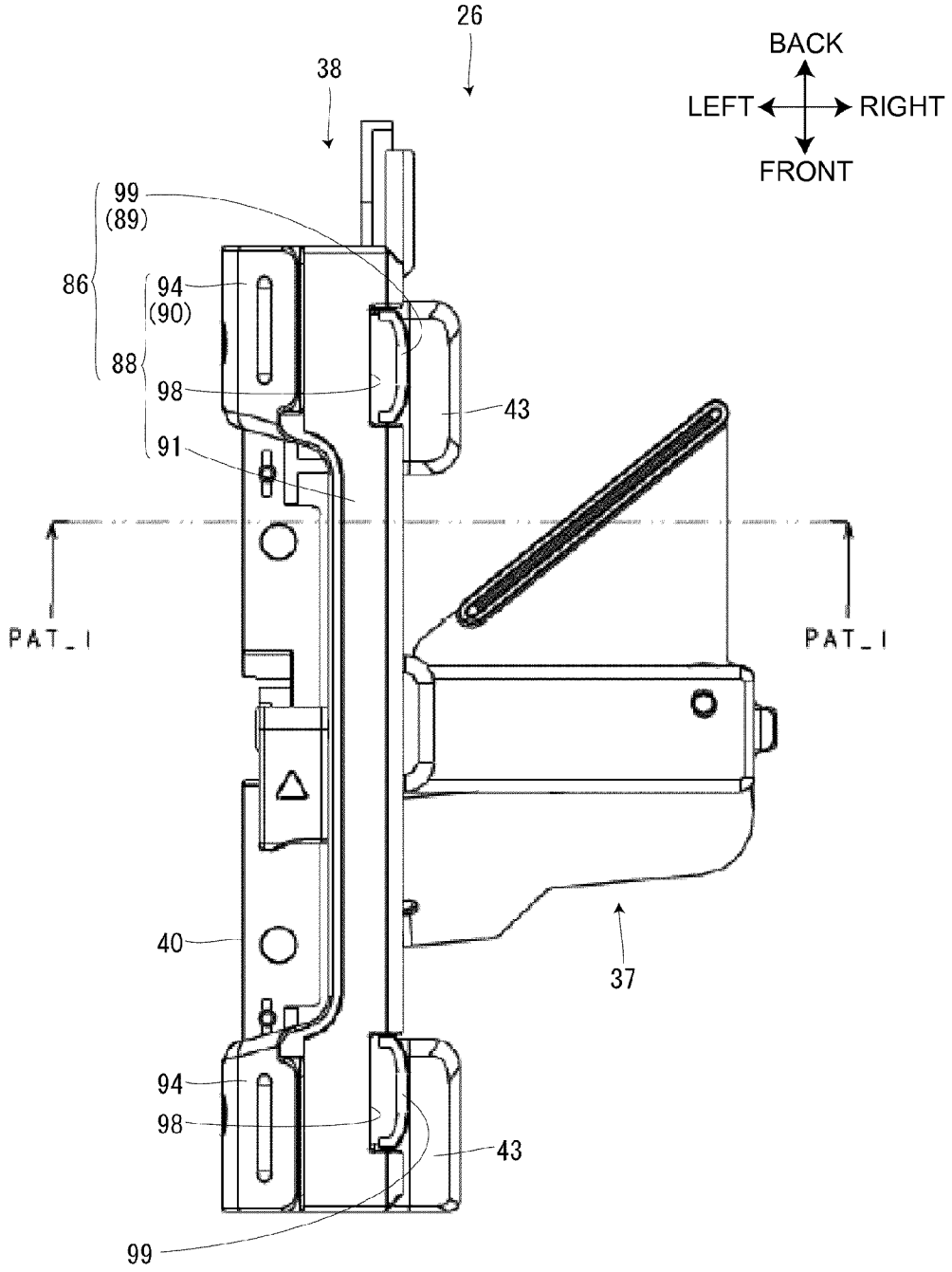
FIG. 11 is a plan view of the movable part.

The retractable slider 44 thus comprised is pushed by the presser lever stop 96 engaged by the slider stop 66 when the movable-side presser lever 86 pivots to the release position, and advances to the advanced position (FIG. 9A). When the movable-side presser lever 86 pivots to the pressure position, the presser lever stop 96 separates from the slider stop 66, the slider guide 63 is pushed by the slider pusher 97, and the retractable slider 44 retracts to the retracted position (FIG. 9B).

As shown in FIG. 6 to FIG. 8 and FIG. 10, the lock mechanism 37 has a lock plate 72 from which the lock pin 71 that enters the oval lock hole 53 of the box unit 45 rises, a support plate 73 that supports the lock plate 72 pivotably between the support plate 73 and the box unit 45, a lock spring 74 that urges the lock plate 72 rotationally, and a lock release lever 75 that rotates the lock plate 72 in resistance to the lock spring 74.

The lock plate 72 is a plate of steel or other metal, has its long dimension extending in the transverse direction, and is basically L-shaped horizontally. A lock tab 76 is formed vertically at a position near the back right side of the lock plate 72. A rubber or other dielectric wear member 77 is attached to the lock tab 76.

The wear member 77 and the lock pin 71 are disposed on the front and back sides of the guide shaft 35. The lock plate 72 is configured pivotably between a locked position (FIG. 10A) where the lock pin 71 and wear member 77 contact the guide shaft 35, and an unlocked position (FIG. 10C) where the lock pin 71 and wear member 77 are separated from the guide shaft 35.

The lock pin 71 is a columnar metal pin that is crimped to the right back end part of the lock plate 72. The diameter of the lock pin 71 is substantially the same as the width of the oval lock hole 53, and is fit into the oval lock hole 53. As a result, the box unit 45 (movable guide 36) in which the oval lock hole 53 is formed is positioned on the transverse axis to the lock plate 72. As the lock plate 72 pivots, the lock pin 71 moves along the oval lock hole 53. Because the lock pin 71 is round, there is no play between the lock pin 71 and the oval lock hole 53 (box unit 45) even when the lock pin 71 moves in the oval lock hole 53 in conjunction with the lock plate 72 pivoting. As a result, when the lock plate 72 rotates to the lock position, the lock plate 72 can be locked to the guide shaft 35 with no chatter in the movable guide 36.

A release lever stop 78 is formed downward from the back left part of the lock plate 72. The bottom end (release lever operator 85) of the lock release lever 75 contacts the release lever stop 78. A front lock spring catch 79 is formed curving to the left near the front left side of the lock plate 72. The front end of the lock spring 74 is engaged by the distal end of the front lock spring catch 79. A through-hole 81 through which a set screw 80 described below passes and is large enough to allow the lock plate 72 to pivot is formed near the lock pin 71.

The support plate 73 is disposed covering the bottom of the box unit 45 with the lock plate 72 therebetween, and is fastened to the box unit 45 by the set screw 80, the distal end of which is threaded into the top of the box unit 45 (see FIG. 8). As a result, the lock plate 72 is supported pivotably on the support plate 73 (see FIG. 7).

A resistor guide 82 that engages the detection lever (not shown in the figure) of a variable resistor that detects the position of the movable guide 36 (position widthwise to the die-cut label paper P) is also disposed on the support plate 73.

The lock spring 74 is a tension spring, the front end held by the front lock spring catch 79 of the lock plate 72, and the back end held by the lock spring catch 54 of the box unit 45. As shown in FIGS. 10A-10C, the lock spring 74 urges the lock plate 72 to rotate to the locked position (clockwise as seen in the figures).

The lock release lever 75 is shaped like an inverted P when seen in vertical section, and is pivotably supported on the guide shaft 35 through the guide tube sleeve 49 of the box unit 45. The lock release lever 75 has a release lever insertion unit 83 formed near the bottom of the box unit 45, a release lever grip 84 formed at the top, and a release lever operator 85 formed at the bottom. The release lever operator 85 engages the release lever stop 78 of the lock plate 72.

The lock release lever 75 pivots between an unreleased position where the release lever grip 84 is exposed to the front of the release lever cover 47, and a released position where the release lever grip 84 is inside the release lever cover 47. More specifically, the lock release lever 75 is urged to the unreleased position by the lock spring 74 through the lock plate 72. When the user holds the release lever grip 84 and rotates the lock release lever 75 to the release position in resistance to the lock spring 74, the lock plate 72 rotates from the locked position to the unlocked position.

As shown in FIGS. 10A-10C, the wear member 77 of the lock plate 72 and the lock pin 71 are disposed on opposite (front and back) sides of the guide shaft 35 in the lock mechanism 37 according to this embodiment. As a result, when the lock plate 72 rotates to the locked position (FIG. 10A), the wear member 77 is urged rotationally by the lock spring 74 to the guide shaft 35 pivoting on the lock pin 71, and the lock pin 71 is urged rotationally by the lock spring 74 to the guide shaft 35 pivoting at the wear member 77. More specifically, when the lock plate 72 pivots to the locked position, force using the lock pin 71 contacting the guide shaft 35 as the fulcrum, and using the distal end of the front lock spring catch 79 on which the lock spring 74 is engaged as the point of effort. Force using the wear member 77 in contact with the guide shaft 35 as the fulcrum, and the distal end of the front lock spring catch 79 as the point of effort, is also applied from the lock pin 71 to the guide shaft 35.

When the user rotates the lock release lever 75 to the release position against the lock spring 74, the lock plate 72 rotates counterclockwise using the wear member 77 contacting the guide shaft 35 as a fulcrum until the lock pin 71 contacts the back end of the oval lock hole 53 (the middle position shown in FIG. 10B). The lock plate 72 also pivots using the lock pin 71 in contact with the back end of the oval lock hole 53 as a fulcrum from the middle position to the unlocked position (FIG. 10C) where the wear member 77 is separated from the guide shaft 35. The user can then slide the movable part 26.

After the user slides the movable part 26 and releases the lock release lever 75, the urging force of the lock spring 74 causes the lock plate 72 to pivot on the lock pin 71 in contact with the back end of the oval lock hole 53 clockwise from the unlocked position to the middle position with the wear member 77 in contact with the guide shaft 35. The lock plate 72 then continues pivoting clockwise from the middle position to the lock position using the wear member 77 in contact with the guide shaft 35 as the fulcrum. When the lock plate 72 rotates from the unlocked position to the locked position, the lock plate 72 thus rotates first to a middle position where the wear member 77 contacts the guide shaft 35, and then pivots on the wear member 77 until the lock pin 71 contacts the guide shaft 35 at the locked position. As a result, both the wear member 77 and the lock pin 71 can be made to positively contact the shaft member without requiring strict dimensional precision in the lock plate 72.

Note that in this embodiment the lock pin 71 and the wear member 77 contact the guide shaft 35 to produce friction (lock) and position the movable guide 36 relative to the lock plate 72, but the locking position and the positioning position could be separate positions.

As shown in FIG. 4, FIG. 5, FIG. 9A, FIG. 9B and FIG. 11, the movable-side presser mechanism 38 has movable-side presser levers 86 that are C-shaped in top view and are supported pivotably on the two presser lever supports 46, and two lever springs 87 disposed on the presser lever supports 46.

While allowing conveyance of the die-cut label paper P, the movable-side presser lever 86 presses the left edge of the die-cut label paper P to the flat surface 61*a* of the pressure-bearing end 61 described above. Because this prevents the left edge of the die-cut label paper P from lifting away from the flat surface 61*a* of the pressure-bearing end 61, creasing along the left edge due to the left edge lifting up is prevented.

The movable-side presser lever 86 is configured to pivot between the released position (FIG. 9A) where the distal end (sheet presser part 99 described below) is separated from the die-cut label paper P, and a pressure position (FIG. 9B) where the die-cut label paper P is pressed to the flat surface 61*a* by the distal end. To convey the die-cut label paper P for a printing process, for example, the user rotates the movable-side presser levers 86 to the pressure position. As a result, the die-cut label paper P is conveyed with the left edge pressed down by the movable-side presser levers 86. To load die-cut label paper P on the feed plate 25, for example, the user rotates the movable-side presser levers 86 to the open released position. As a result, the user can easily position the die-cut label paper P on the feed plate 25.

As shown in FIGS. 9A and 9B, the movable-side presser lever 86 includes a clamshell-like presser lever case 88, and two (front and back) sheet presser arms 89 housed inside the presser lever case 88. The presser lever case 88 can have a substantially rectangular presser lever end part 90 on both front and back ends, and a pressure lever connector 91 that connects the two presser lever end parts 90.

Each presser lever end part 90 has an outside protrusion 92 and an inside protrusion 93 formed protruding from the pivot base end (left side), and a presser lever grip 94 formed at the distal end (right side). As shown in FIGS. 4 and 5, the two outside protrusions 92 are disposed on the outside front and back with the two inside protrusions 93 therebetween.

A presser lever pivot hole (not shown in the figure) to which the support boss 57 engages from the front or back outside side is formed in each outside protrusion 92. Each outside protrusion 92 is formed as a curved surface that curves from the top down the left side, and continues from the left side curving along the bottom through a shoulder.

As shown in FIGS. 9A and 9B, a top lever spring catch 95 that holds the top end of the lever spring 87 protrudes from an outside front or back surface (the surface opposite the adjacent outside protrusion 92) of each inside protrusion 93. Like the outside protrusion 92, the inside arm part of each presser lever is formed as a curved surface that curves from the top down the left side, and continues from the left side curving along the bottom through a shoulder. This shoulder is the presser lever stop 96 that engages the slider stop 66 of the retractable slider 44. More specifically, when the movable-side presser lever 86 rotates to the open released position, the presser lever stop 96 contacts the slider stop 66 (FIG. 9A), and when the movable-side presser lever 86 rotates to the closed pressure position, the presser lever stop 96 separates from the slider stop 66 (FIG. 9B).

Note that the shoulder of each outside protrusion 92 could engage the slider stop 66 of the retractable slider 44 together with or instead of the presser lever stop 96 of the inside protrusion 93.

As seen from the conveyance direction, the pressure lever connector 91 is formed at substantially 90° to the presser lever end parts 90. Slider pushers 97 (advancing/retracting member pusher) protrude at two (front and back) locations from the left side of the pressure lever connector 91, that is, from the surface opposite the slider guide 63 of the retractable slider 44 in the pressure position. When the movable-side presser lever 86 pivots to the pressure position, the two slider pushers 97 push against the slider guide 63 (guide surface), and the retractable slider 44 retracts to the retracted position (FIG. 9B). When the movable-side presser lever 86 pivots to the open released position, the two slider pushers 97 separate from the slider guide 63 (FIG. 9A).

Note that this embodiment is configured so that the slider pushers 97 push the slider guide 63 to retract the retractable slider 44 to the retracted position, but the position pushed by the slider pushers 97 is not so limited. For example, an engaging part that engages the slider stop 66 and retracts the retractable slider 44 to the retracted position when the movable-side presser lever 86 rotates to the pressure position, and separates from the presser lever stop 96 when the movable-side presser lever 86 rotates to the open released position, could be formed to the inside protrusion 93 at a different circumferential position than the presser lever stop 96. As in this embodiment, the slider pushers 97 can push directly against the slider guide 63 to smoothly retract the slider guide 63 (guide surface) of the retractable slider 44.

Arm holes 98 through which the sheet presser parts 99 (described below) of the sheet presser arms 89 protrude from inside the case are formed respectively at the front and back ends of the distal ends (bottom) of the pressure lever connector 91.

The sheet presser arms 89 are supported rotatably inside the front and back inside ends of the pressure lever connector 91, and the sheet presser parts 99 are formed at the front and back outside ends. Each sheet presser part 99 is formed with a gentle curve on the bottom. An arm spring 100 (compression spring) (see FIG. 4) that urges the sheet presser parts 99 so that the sheet presser parts 99 protrude from the arm holes 98 is housed inside the pressure lever connector 91. As a result, the bottom surfaces of the sheet presser parts 99 protruding from the arm holes 98 contact the left edge part of the die-cut label paper P, and the sheet presser arms 89 elastically press down against the left edge of the die-cut label paper P. The left edge of the die-cut label paper P can therefore be pressed with pressure desirably balanced between the front and back sheet presser parts 99.

The sheet presser arms 89 also preferably push near the left edge in order to effectively prevent buckling of the left edge of the die-cut label paper P. For example, pressure length L2 (the distance from the slider guide 63 to where pressure is applied by the sheet presser arm 89) is preferably 1-13 mm. Note that the sheet presser arms 89 can be configured to press the left edge part of the die-cut label paper P to the pressure-bearing base unit 62 (inclined surface 62*a*).

The lever spring 87 is a tension spring, the top end held by the top lever spring catch 95 of the movable-side presser lever 86, and the bottom end caught on the lever spring bottom catch 59 of the presser lever support 46. Each lever spring 87 functions as a so-called bi-stable spring.

As a result, the movable-side presser lever 86 is urged between the pressure position and the released position by the lever springs 87 from a neutral point between the pressure position and the released position (a position where the lever springs 87 are upright). The lever spring 87 is not limited to a tension spring, and could be any elastic member that thus functions as a bi-stable spring, including a torsion spring, for example.

The spring force of the lever spring 87 is set appropriately to the force required to rotate the movable-side presser lever 86 and the pressure of the movable-side presser lever 86 on the die-cut label paper P. More specifically, the pressure on the die-cut label paper P from the movable-side presser lever 86 is sufficient to effectively prevent breaking the left edge of the die-cut label paper P, and not enough to interfere with conveying the die-cut label paper P.

As shown in FIG. 4 and FIG. 5, the stationary part 27 includes a stationary guide 136 fastened to the right side of the feed plate 25, and a stationary side edge presser mechanism 138 disposed on the stationary guide 136 to press against the right edge part of the die-cut label paper P.

The stationary guide 136 includes a block part 141 with a guide surface that contacts the right side edge of the die-cut label paper P, and a stationary-side pressure bearing member 143 extending to the left from the bottom of the guide surface of the block part 141. Side presser members 142 configured identically to the side presser member 42 of the movable guide 36 are respectively attached to the front and back ends of the block part 141.

Presser lever supports 146 configured identically to the presser lever supports 46 of the movable guide 36 are respectively formed on the front and back ends of the block part 141. The stationary-side presser lever 186 of the stationary side edge presser mechanism 138 configured identically to the movable-side presser lever 86 of the movable-side presser mechanism 38 is pivotably supported by the presser lever supports 146. The stationary-side presser lever 186 is also urged to the pressure position and the released position by a lever spring 187 in the same way as the movable-side presser lever 86.

The stationary-side pressure bearing member 143 is a basically rectangular plate that is long on the longitudinal axis. Like the movable-side pressure bearing member 43, the stationary-side pressure bearing member 143 has a pressure-bearing end 161 with a top (flat surface 161*a*) that is substantially flush with the top of the feed plate 25, and a pressure-bearing base unit 162 with an inclined surface 162*a* that rises from the flat surface 161*a* toward the base.

Operation of parts of the guide unit 21 thus comprised is further described below in the operation whereby the user sets die-cut label paper P to the feed plate 25, and the subsequent die-cut label paper P conveyance process.

To set the die-cut label paper P onto the feed plate 25, the user first opens the access cover 17 and rotates the stationary-side presser lever 186 from the pressure position to the released position. To do this, the user rotates the stationary-side presser lever 186 in resistance to the lever spring 187 from the pressure position to the neutral point. When the neutral point is passed, the urging direction changes and the stationary-side presser lever 186 can be rotated to the released position without resisting the lever spring 187. The stationary-side presser lever 186 is then held in the released position by the urging force of the lever spring 187.

Before or after rotating the stationary-side presser lever 186 to the released position, the user also rotates the movable-side presser lever 86 from the pressure position to the released position. In this operation the user also rotates the movable-side presser lever 86 in resistance to the lever spring 87 from the pressure position to the neutral point, the urging direction changes when the neutral point is passed, and the movable-side presser lever 86 can then be rotated to the released position without resistance from the lever spring 87.

When the movable-side presser lever 86 rotates to the released position, the presser lever stop 96 of the movable-side presser lever 86 engages the slider stop 66 and the retractable slider 44 is pushed to the advanced position, as shown in FIG. 9A. At this time the lever spring 87 urges the retractable slider 44 to the advanced position through the movable-side presser lever 86. More specifically, the movable-side presser lever 86 is held in the released position and the retractable slider 44 is held in the advanced position by the urging force of the lever spring 87 (FIG. 9A). The user then sets the die-cut label paper P on the feed plate 25 while the stationary-side presser lever 186 and the movable-side presser lever 86 are held in their respective released positions.

Next, the user rotates the lock release lever 75 from the unreleased position to the release position.

As a result, the lock plate 72 pivots from the locked position through the neutral position to the unlocked position (FIG. 10C). When the lock plate 72 is in the unlocked position, both the wear member 77 and the lock pin 71 separate from the guide shaft 35, and the movable part 26 can be slid smoothly on the transverse axis without producing friction (sliding resistance) between the wear member 77 and lock pin 71 and the guide shaft 35.

The user can slide the movable guide 36 on the transverse axis and adjust the guide width until the slider guide 63 of the retractable slider 44 contacts the left edge of the die-cut label paper P.

Note that a configuration that makes rotating the lock release lever 75 to the release position difficult for the user when the movable-side presser lever 86 is in the pressure position is preferable. For example, the movable-side presser lever 86 could be shaped to prevent accessing the lock release lever 75 when the movable-side presser lever 86 is in the pressure position. As a result, the user can be prevented from sliding the movable guide 36 when the movable-side presser lever 86 is pressing against the die-cut label paper P.

When the user releases the lock release lever 75 after adjusting the guide width, the lock release lever 75 pivots to the unreleased position due to the urging force of the lock spring 74, and the lock plate 72 pivots from the unlocked position through the neutral position to the locked position (FIG. 10A). When the lock plate 72 is rotated to the locked position, the wear member 77 is urged rotationally by the lock spring 74 to the guide shaft 35 using the lock pin 71 as a fulcrum, and the lock pin 71 is urged rotationally by the lock spring 74 to the guide shaft 35 using the wear member 77 as a fulcrum. As a result, both the wear member 77 and lock pin 71 contact the guide shaft 35 with great force, producing friction between the wear member 77 and guide shaft 35 and between the lock pin 71 and guide shaft 35. Friction between the lock plate 72 and the guide shaft 35 can therefore be increased without using a lock spring 74 with a strong urging force. The movable guide 36 can therefore be clamped firmly when locked without making unlocking the movable guide 36 more difficult, that is, without requiring a strong operating force to rotate the lock release lever 75 to the unreleased position in resistance to the lock spring 74.

When in the locked position, the lock plate 72 is electrically connected to the guide shaft 35 through the metal (conductive) lock pin 71, and is connected to ground through the guide shaft 35. As a result, the lock plate 72 can be prevented from being ungrounded and electrically charged even if a dielectric (such as rubber) material is used for the wear member 77. Adversely affecting nearby sensors (such as the variable resistor described above) as a result of the lock plate 72 being charged can therefore be prevented.

When the movable guide 36 is locked to the guide shaft 35 by the lock mechanism 37, the user rotates the stationary-side presser lever 186 from the released position to the pressure position. At this time the user rotates the stationary-side presser lever 186 in resistance to the lever spring 187 from the released position to the neutral point, the urging direction then changes past the neutral point, and the stationary-side presser lever 186 can be rotated to the pressure position without resistance from the lever spring 187. When pivoted to the pressure position, the stationary-side presser lever 186 presses the right side of the die-cut label paper P to the stationary-side pressure bearing member 143 due to the urging force of the lever spring 187.

Note that rotating the stationary-side presser lever 186 from the released position to the pressure position could be done after setting the die-cut label paper P on the feed plate 25 and before sliding the movable guide 36.

The user also rotates the movable-side presser lever 86 from the released position to the pressure position before or after rotating the stationary-side presser lever 186 to the pressure position. In this event, the user rotates the movable-side presser lever 86 in resistance to the lever spring 87 from the released position to the neutral point, the urging direction then changes past the neutral point, and the movable-side presser lever 86 can be rotated to the pressure position without resistance from the lever spring 87. When pivoted to the pressure position, the movable-side presser lever 86 presses the left side of the die-cut label paper P to the movable-side pressure bearing member 43 due to the urging force of the lever spring 87.

When the movable-side presser lever 86 rotates to the pressure position, the presser lever stop 96 of the movable-side presser lever 86 separates from the slider stop 66. As a result, the retractable slider 44 is no longer held in the advanced position by the lever spring 87 through the movable-side presser lever 86. When the urging force is thus released, the slider pushers 97 of the movable-side presser lever 86 pivoted to the pressure position push against the slider guide 63 of the retractable slider 44, and the retractable slider 44 retracts to the retracted position (FIG. 9B). This increases the guide width slightly compared with the adjusted guide width, and enables the conveying of the die-cut label paper P without applying excessive feed resistance to the die-cut label paper P.

As described above, the retractable slider 44 advances to an advanced position and is held in the advanced position in conjunction with the movable-side presser lever 86 rotating to the released position, and the retractable slider 44 retracts to the retracted position in conjunction with the movable-side presser lever 86 rotating to the pressure position, by means of an interlocking mechanism including the presser lever stop 96, slider pushers 97, and lever spring 87. Because the retractable slider 44 advances and retracts in conjunction with rotating the movable-side presser lever 86, the user does not need to perform separate actions to rotate the movable-side presser lever 86 and advance or retract the retractable slider 44, and operability can be improved.

The user closes the access cover 17 after setting the die-cut label paper P as described above. The printer 10 starts the die-cut label paper P conveyance process when a print command is received from the data processing terminal. Because the pressure-bearing base units 62, 162 (inclined surface 62*a*, 162*a*) cause the sides of the die-cut label paper P conveyed over the feed plate 25 to slope up, the side can be prevented from folding and buckling up to the coated side 1*a* side (printed side) (FIG. 9A and FIG. 9B). Because incisions 3 are formed in the coated side 1*a* of the die-cut label paper P as described above, the die-cut label paper P can easily buckle convexly to the coated side 1*a* at the position where an incision 3 is formed. However, because the edge part of the die-cut label paper P including where the incisions 3 are formed slopes up, the printer 10 can prevent the die-cut label paper P from buckling convexly to the coated side 1*a* at the incisions 3.

Furthermore, because the area around the inclined edge area is pressed down by the sheet presser parts 99, 199, the sides of the die-cut label paper P are also prevented from lifting away from the flat surfaces 61*a*, 161*a* of the pressure-bearing ends 61, 161. The sides of the die-cut label paper P are also prevented from lifting away from the flat surfaces 61*a*,

161*a* of the pressure-bearing ends 61, 161 by the contact surfaces 42*a*, 142*a* pressing against the sides of the die-cut label paper P (FIG. 9). Wrinkling (buckling) the sides as a result of the sides lifting up can therefore be prevented.

Folding the sides of the die-cut label paper P can also be prevented, and the edges of the die-cut label paper P conveyed over the top of the feed plate 25 can be guided, by using a fold prevention means including the inclined surface 62*a*, 162*a*, sheet presser part 99, 199, and contact surface 42*a*, 142*a*.

Because a fold prevention means (inclined surface 62*a*, sheet presser part 99, and contact surface 42*a*) is disposed on both the front and back ends of the movable part 26, wrinkling or breaking the left side of the die-cut label paper P can be effectively prevented at the front and back ends of the movable guide 36 against which skewed die-cut label paper P is pushed strongly. Because the fold prevention means is also disposed on the stationary part 27, wrinkling the sides of the die-cut label paper P can be prevented whether the die-cut label paper P skews to the right or left.

As described above, the printer 10 according to this embodiment has lever springs 87, 187 that respectively urge the movable-side presser lever 86 and the stationary-side presser lever 186 to a pressure position and a release position from a neutral point. As a result, the movable-side presser lever 86 and stationary-side presser lever 186 that press the die-cut label paper P can be reliably operated to the pressure position and the release position. The ease of setting the die-cut label paper P used as the print medium on the feed plate 25 can therefore be improved.

To prevent folding the sides of the die-cut label paper P, the movable-side presser lever 86 and stationary-side presser lever 186 press down on the sides of the die-cut label paper P through a sheet presser part 99, 199, respectively, but the disclosure is not limited to pressing the die-cut label paper P at a specific position, and can also be applied to press the die-cut label paper P in the middle of the width, for example.

This embodiment of the disclosure is described using an inkjet printing method, but the disclosure is not so limited and can be applied to thermal printers, for example. Die-cut label paper P is also used as an example of sheet media, but the sheet media could be plain roll paper, fanfold paper, or other type of continuous sheet media, or cut-sheet paper.

The disclosure being thus described, it will be apparent that it may be varied in many ways. Such variations are not to be regarded as a departure from the spirit and scope of the disclosure, and all such modifications as would be apparent to one skilled in the art are intended to be included within the scope of the following claims.

What is claimed is:

1. A sheet pressing device comprising:

a presser lever configured pivotably between a pressure position where a sheet material conveyed over a feed path surface is pressed to the feed path surface by a sheet presser part, and a released position where the sheet presser part is separated from the sheet material;

an elastic member that urges the presser lever to the pressure position or the released position from a neutral point between the pressure position and the released position;

a base unit configured to slide on a transverse axis perpendicular to the conveyance direction;

a retractable slider having a guide surface that guides a side edge of the sheet material conveyed over the feed path surface, said retractable slider being held on the base unit movably between an advanced position and a retracted position relative to the sheet material; and an interlocking mechanism that advances the retractable slider to the advanced position in conjunction with the presser lever rotating to the released position and holds the retractable slider in the advanced position, and retracts the retractable slider to the retracted position in conjunction with the presser lever rotating to the pressure position.

2. The sheet pressing device described in claim 1, wherein:

the interlocking mechanism includes a lever engaging part that is formed on the presser lever, engages the retractable slider when the pressure lever rotates to the released position, and separates from the retractable slider when the presser lever rotates to the pressure position, a retractable slider pusher that is formed on the presser lever, pushes the retractable slider to the retracted position when the presser lever rotates to the pressure position, and retracts from the retractable slider when the presser lever rotates to the released position, and an elastic member that urges the retractable slider to the advanced position through the presser lever.

3. The sheet pressing device described in claim 2, wherein:

the retractable slider pusher presses against the guide surface of the retractable slider.

4. The sheet pressing device described in claim 1, wherein:

the presser lever has a sheet presser part at plural locations dispersed in the conveyance direction; and a plurality of urging members respectively urge the plural sheet presser parts toward the sheet material.

5. A printer comprising:

the sheet pressing device described in claim 1;

a conveyance unit that conveys the sheet material over the feed path surface; and a printer that prints on the sheet material.

* * * * *